United States Patent [19]

Van Melle

[11] Patent Number: 5,014,867

[45] Date of Patent: May 14, 1991

[54] CONTAINER

[75] Inventor: Jean Van Melle, Schilde, Belgium

[73] Assignee: Tates, Antwerp, Belgium

[21] Appl. No.: 336,761

[22] Filed: Apr. 12, 1989

[51] Int. Cl.[5] ..... B65D 21/02; B65D 88/12

[52] U.S. Cl. ..... 220/1.5; 206/511; 206/512

[58] Field of Search ..... 206/511, 512; 220/1.5

[56] References Cited

U.S. PATENT DOCUMENTS

| | | | |
|---|---|---|---|
| 2,732,967 | 1/1956 | Metcalf | 206/511 |
| 3,085,707 | 4/1963 | Tantlinger | 206/512 |
| 3,618,999 | 11/1971 | Hlinsky . | |

FOREIGN PATENT DOCUMENTS

| | | | |
|---|---|---|---|
| 530950 | 8/1954 | Belgium | 206/511 |
| 2728663 | 1/1979 | Fed. Rep. of Germany | 206/511 |
| 62679 | 6/1955 | France | 220/1.5 |
| 1202566 | 8/1970 | United Kingdom . | |

*Primary Examiner*—George E. Lowrance

*Attorney, Agent, or Firm*—Scully, Scott Murphy & Presser

[57] ABSTRACT

Container structure provided at the bottom, on its front and back side, with small beams and with beams mounted in a lateral direction, whereby at least on the neighborhood of twistlocks, which are provided on four corners of a container, at least on small cross-beams, a reinforcement profile is provided, whereby said reinforcement profile is substituted by a buffer block, which at the under side and following a vertical cross-section, has at least one inclined plane, in such a manner that by a setting down of a container on another container, said twistlock of a container slides along said inclined plane of said container to be set down without deforming said inclined plane.

5 Claims, 2 Drawing Sheets

CONTAINER

BACKGROUND OF THE INVENTION

The invention relates to a container provided with small beams at the bottom, on its front and back side, and with beams mounted in the longitudinal direction, whereby at least in the neighbourhood of the twistlocks, which are provided on the four corners of the container, at least on the small cross beams a reinforcement profile is provided.

By the shipping of containers, particularly by piling up the containers on each other, it often happens that the twistlock head, which has the shape of a mushroom, crushes in and deforms the reinforcement profile of a container which has to be piled up on the first container.

This due to the fact that, notwithstanding the trend of automatising the setting down or piling up of the containers, it is not possible to execute this operation without any errors.

It also seems that more than 25% of the repairing costs on containers is due to damages on the above described reinforement profile.

SUMMARY OF THE INVENTION

It is then also the object of the invention to present a container offering a suitable solution to the mentioned problem.

In order to realize this according to the invention, said reinforcement profile is substituted by a buffer block, which at the under side and following a vertical cross-section, has at least one inclined plane in such a manner that by the setting down of a container on another one, the twistlock of a container slides away along said inclined plane of the container to be set down without deforming said inclined plane.

Still according to the invention said buffer lock at its under side has the shape of a triangle of which at least the bottom corner is rounded off.

Other details and advantages of the invention will become clear from the description given hereunder of a container according to the invention. This description is only given by way of example and does not limit the scope of the invention. The references relate to annexed figures.

BRIEF DESCRIPTION OF THE DRAWINGS

The FIGS. 1 to 4 show schematically three possible erroneous contacts between the twistlocks and the reinforcement profile of the container situated at the underside.

DETAILED DESCRIPTION OF THE PREFERRED EMBODIMENTS

Figure 1:
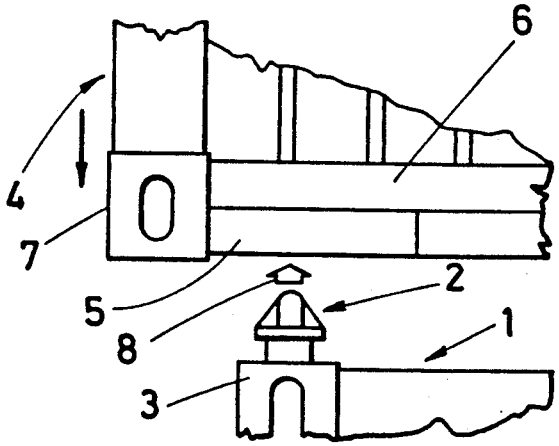

When reference is made to FIG. 1, it can be observed, according to a front view on the back or front side of a container, how the latter is set down erroneously with respect to a container situated thereunder.

The container situtated thereunder is reduced to the upper cross-beam 1 and the mushroom-shaped head 2 of the twistlock 3. The upper container 4 which has to be put on the container situated thereunder, is here also reduced to the reinforcement profile 5 of the under small cross-beam 6. The twistlock 7 situated at the under side can be considered as the female element of thr twistlock system.

The erroneous position of the container 4 with respect to the container 1 is indicated by the little arrow 8.

Figure 2:
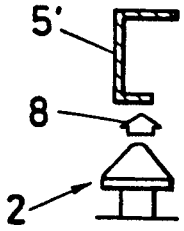
Figure 3:
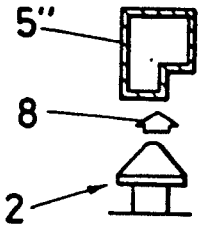
Figure 4:
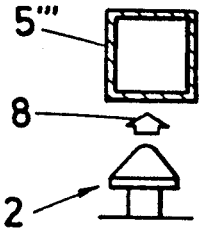

The shape which the reinforcement profile 5 can have, is schematically and following cross-sections made clear in the FIGS. 2, 3 and 4.

In the figures the containers are essentially represented by a side view. It will be clear that the problems discussed here can also happen along the lateral sides of the containers. The invention also relates to an improvement of the lateral beam reinforcement profile.

Figure 5:
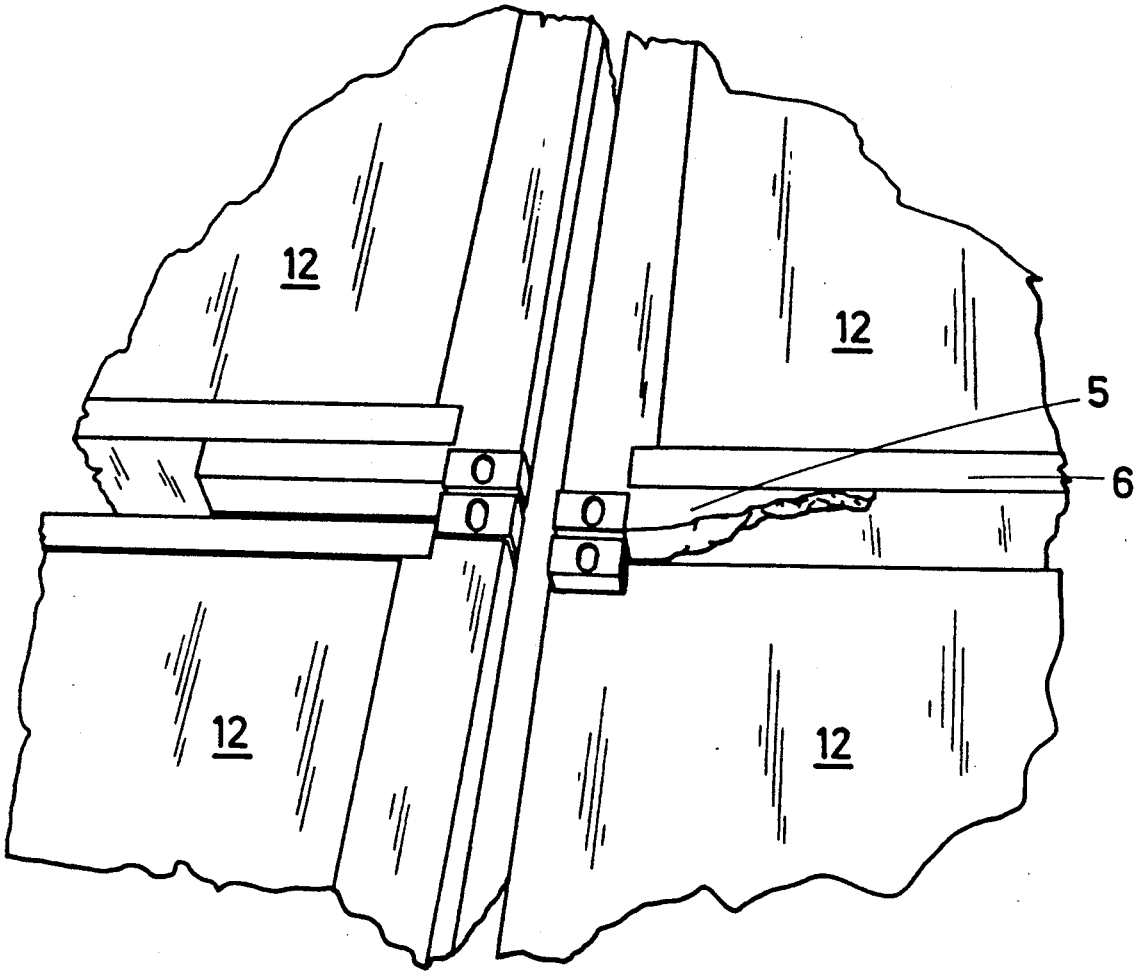
FIG. 5 shows, by way of an example, the damages which can occur at the reinforcement profile of the container, when piling up.

Whatever may be the shape in cross-section of that reinforcement profile, the damage on such a reinforcement profile remains the origin of the rather high repairing costs. In FIG. 5, where four piled up containers are partially represented, there is illustrated how a reinforcement profile 5 of a container 152 was damaged. The same damage can also occur on the lateral beam 6 when the reinforcement profile 5 is not present thereon.

Experience has proven that the damages always occur in a zone which is relatively in the direct neighbourhood of the female element 7 of the twistlock members.

The erroneous setting down of a container on another happens relatively often, notwithstanding all measures which under more have lead to a very pronounced automatising according to which there is tried to put the container in the correct position above the container which is situated thereunder.

Figure 6:
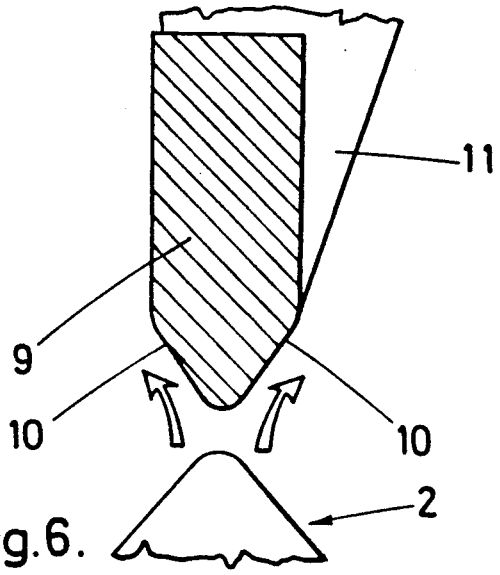
FIG. 6 shows schematically and at an independent scale, a vertical cross-section through the reinforcement profile of a container according to the invention.

According to the invention the protection profile (5', 5'', 5''' according to FIGS. 2, 3 and 4 respectively) used until now is replaced by a buffer block which at the under side has at least one, but preferably two, inclined planes. Such a buffer block is shown in FIG. 6. In that figure, the buffer block 9 according to the invention is situated just above the conical or mushroom-shaped head of the twistlock 2.

The buffer block 9 according to FIG. 6 shows, at the under side, a triangle shape with rounded off angles. By erroneous setting down of a container, the oblique sides 10 of that triangle will, unavoidably, slide away along the conical head 2 of the male twistlock, without causing a damage to the buffer block 9.

The buffer block 9 is laterally and along its inner side provided with a knee-bend 11 which has the shape of a triangluar metal plate.

By erroneously setting down a container, i.e. when the container 4 is in an erroneous position with respect to a container 1, as illustrated in FIG. 1, the head 2 of the twistlock of the container situated at the under side unavoidebly slides laterally along one of the two sides 10 of the buffer block 9 according to the invention without causing thereto damages.

The buffer block 9, which is preferably manufactured of casted material, can be manufactured in several lengths and it will also be clear thay many modifications can be applied to the cross-section of that buffer block without leaving the scope of the present patent application.

What is claimed is:

1. In a container adapted to be stacked upon another container, and including at least a plurality of bottom beams forming at least one bottom corner of the container, and a lock receiving member located at said corner and forming a bottom opening to receive a head of a twistlock of said another container, the improvement comprising:

a buffer block secured to one of said bottom beams immediately adjacent the lock receiving member, and including at least a first surface slanting upwardly and laterally to guide the head of the twisterlock of said another container away from said one of the bottom beams when the container is lowered onto said another container.

2. A container according to claim 1, wherein, in a vertical plane extending through the buffer block, said buffer block has a triangular shaped cross-section and forms a curved, bottom corner.

3. A container according to claim 1, wherein:

the buffer block including a second surface slanting upwardly from said bottom corner and laterally away from the first surface; and as the container is lowered onto said another container, (i) if the locking head of the twistlock engages the buffer block on a first lateral side of the bottom corner, the first surface of the buffer block guides said head away from said one of the bottom beams, and (ii) if the head of the twistlock engages the buffer block on a second lateral side of the bottom corner, the second surface of the buffer block guides said head away from said one of the bottom beams.

4. A container according to claim 1, wherein:

the buffer block includes an underside forming a rounded bottom corner;

the first surface of the buffer block extends upwardly and laterally in a first direction, from said bottom corner;

the buffer block further includes a second surface extending upwardly and laterally in a second direction from said bottom corner; and as the container is lowered onto said another container, (i) if the head of the twistlock engages the buffer block on a first lateral side of the bottom corner, the first surface of the buffer block guides said head away from said one of the bottom beams, and (ii) if the head of the twistlock engages the buffer block on a second lateral side of the bottom corner, the second surface of the buffer block guides said head away from said one of the bottom beams.

5. A container according to claim 2, the improvement further comprising a triangular shaped plate engaging the buffer block to reinforce the buffer block against deformation.

* * * * *

UNITED STATES PATENT AND TRADEMARK OFFICE

CERTIFICATE OF CORRECTION

PATENT NO. : 5,014,867

DATED : May 14, 1991

INVENTOR(S) : Jean Van Melle

It is certified that error appears in the above-indentified patent and that said Letters Patent is hereby corrected as shown below:

On the title page, Abstract, line 3, "on" should read as --in--
Column 1, line 17, "This due" should read as --This is due--
line 37, "lock" should read as --block--
Column 2, line 4, "thr" should read as --the--
line 21, "152" should read as --12--
line 51, "triangluar" should read as --triangular--
line 61, "thay" should read as --that--
Column 3, line 16, Claim 3, "claim 1," should read as --claim 2,--

Signed and Sealed this

Twenty-first Day of June, 1994

*Attest:*

Bruce Lehman

BRUCE LEHMAN

*Attesting Officer*

*Commissioner of Patents and Trademarks*